US009393779B2

(12) United States Patent
Takagi

(10) Patent No.: US 9,393,779 B2
(45) Date of Patent: Jul. 19, 2016

(54) SEMICONDUCTOR DEVICE, LIQUID DISCHARGE HEAD, AND LIQUID DISCHARGE APPARATUS

(71) Applicant: SEIKO EPSON CORPORATION, Tokyo (JP)

(72) Inventor: Toshihito Takagi, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/638,978

(22) Filed: Mar. 4, 2015

(65) Prior Publication Data

US 2015/0251415 A1 Sep. 10, 2015

(30) Foreign Application Priority Data

Mar. 5, 2014 (JP) ..... 2014-042467

(51) Int. Cl.
*B41J 2/045* (2006.01)
*B41J 2/14* (2006.01)

(52) U.S. Cl.
CPC ..... *B41J 2/04541* (2013.01); *B41J 2/0451* (2013.01); *B41J 2/04511* (2013.01); *B41J 2/04581* (2013.01); *B41J 2/04595* (2013.01); *B41J 2/14233* (2013.01); *B41J 2002/14241* (2013.01); *B41J 2002/14354* (2013.01); *B41J 2002/14491* (2013.01)

(58) Field of Classification Search
CPC .... B41J 2/045; B41J 2/04541; B41J 2/04501; B41J 2/0451; B41J 2/04581; B41J 2/04586; B41J 2/0455; B41J 2/04548; B41J 2/04555
See application file for complete search history.

(56) References Cited

U.S. PATENT DOCUMENTS

| | | | | |
|---|---|---|---|---|
| 4,498,088 | A * | 2/1985 | Kanayama | B41J 2/19 347/68 |
| 6,375,299 | B1 * | 4/2002 | Foster | B41J 2/0451 347/19 |
| 8,444,247 | B2 * | 5/2013 | Shinkawa | B41J 2/16526 347/19 |
| 8,777,347 | B2 * | 7/2014 | Shinkawa | B41J 2/04581 347/10 |
| 2003/0156149 | A1 * | 8/2003 | Choi | B41J 2/0451 347/19 |
| 2005/0057596 | A1 * | 3/2005 | Shinkawa | B41J 2/16579 347/19 |
| 2005/0212845 | A1 * | 9/2005 | Shinkawa | B41J 2/0451 347/19 |
| 2006/0187249 | A1 * | 8/2006 | Nishihara | B41J 2/04581 347/7 |
| 2012/0320120 | A1 * | 12/2012 | Suzuki | B41J 2/0451 347/19 |

FOREIGN PATENT DOCUMENTS

JP 2013-233704 A 11/2013

* cited by examiner

*Primary Examiner* — Geoffrey Mruk
*Assistant Examiner* — Scott A Richmond
(74) *Attorney, Agent, or Firm* — Maschoff Brennan

(57) ABSTRACT

A semiconductor device which is provided to correspond to each of a plurality of nozzles discharging a liquid and controls a plurality of drive elements causing a liquid to be discharged from each nozzle by an application of a drive signal includes a detection circuit which detects a residual vibration signal of the drive element, an output terminal which is provided to correspond to each of the plurality of drive elements, a discharge transistor which controls an application of the drive signal to the drive element through the output terminal, and a detection transistor which controls an application of the residual vibration signal to the detection circuit through the output terminal, in which the detection transistor is smaller than the discharge transistor in size, and the discharge transistor is disposed between the detection transistor and the output terminal.

7 Claims, 14 Drawing Sheets

SEMICONDUCTOR DEVICE, LIQUID DISCHARGE HEAD, AND LIQUID DISCHARGE APPARATUS

The entire disclosure of Japanese Patent Application No. 2014-042467, filed Mar. 5, 2014 is expressly incorporated by reference herein.

BACKGROUND

1. Technical Field

The present invention relates to a semiconductor device, a liquid discharge head, and a liquid discharge apparatus.

2. Related Art

As a semiconductor device, a device which is provided for controlling a head of a liquid discharge apparatus (for example, a printer) is known. Drive elements (for example, piezo elements) are provided for each nozzle in a head of a printer. A semiconductor device for controlling a head controls an application of a drive signal to each of the piezo elements. More specifically, a drive signal is applied to the piezo element after selecting a pulse of the drive signal with a printing switch provided in the semiconductor device.

In addition, a device which detects a state (such as defective nozzle) of a nozzle by detecting a residual vibration signal after the application of a drive signal has been proposed in the related art (for example, refer to JP-A-2013-233704). A detection switch for detecting the residual vibration is provided on a side opposite to the printing switch viewed from the piezo element. The printing switch and the detection switch are configured to have a printing transistor (corresponding to discharge transistor) and a detection transistor, respectively.

As described above, when a detection switch is provided on an opposite side to a printing switch viewed from a piezo element, a semiconductor device in which the detection switch is provided is separated from a semiconductor device in which the printing switch is provided. In contrast, when the detection switch is provided on the same side as the printing switch viewed from the piezo element, it is possible to provide the printing switch and the detection switch in the same semiconductor device.

Meanwhile, it takes time to charge or discharge a piezo element when resistance of a printing transistor configuring the printing switch increases, thereby lowering a printing speed. In addition, when the resistance of the printing transistor increases, heat generated when charging or discharging the piezo element becomes a problem. Therefore, it is necessary to lower the resistance of the printing transistor. That is, a size of the printing transistor is increased. A protection resistor cannot be added to the printing transistor which is effective in reducing damage caused by an application of static electricity from the outside due to reduction in resistance according to the above-mentioned needs. However, the printing transistor is configured to reduce the damage by dispersing received static electricity on a large area using a large size of transistor.

Since the size of the printing transistor is large, when providing the detection switch and the printing switch in the same semiconductor device, a layout or a size of the detection switch becomes a problem. Specifically, the detection transistor configuring the detection switch does not need to allow a current to flow therein, and it is desirable to configure the detection transistor in a small transistor size for reduction in a layout area. However, when the size of the detection transistor is reduced, it is of concern that the detection transistor is destroyed by an application of static electricity.

SUMMARY

An advantage of some aspects of the present invention is to suppress an increase in area and ensure resistance to static electricity applied by enabling an layout efficient in providing a switch performing residual vibration detection and the printing switch in the same semiconductor device.

According to an aspect of the invention, there is provided a semiconductor device which is provided to correspond to each of a plurality of nozzles discharging a liquid and controls a plurality of drive elements causing a liquid to be discharged from each nozzle with an application of a drive signal. The semiconductor device includes a detection circuit which detects a residual vibration signal of the drive element, an output terminal which is provided to correspond to each of the plurality of drive elements, a discharge transistor which is provided to correspond to each of the plurality of drive elements and controls an application of the drive signal to the drive element through the output terminal, and a detection transistor which is provided to correspond to each of the plurality of drive elements and controls an application of the residual vibration signal to the detection circuit through the output terminal, in which the detection transistor is smaller than the discharge transistor in size, and the discharge transistor is disposed between the detection transistor and the output terminal.

Other features of the invention will be apparent by a description in the present specification and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
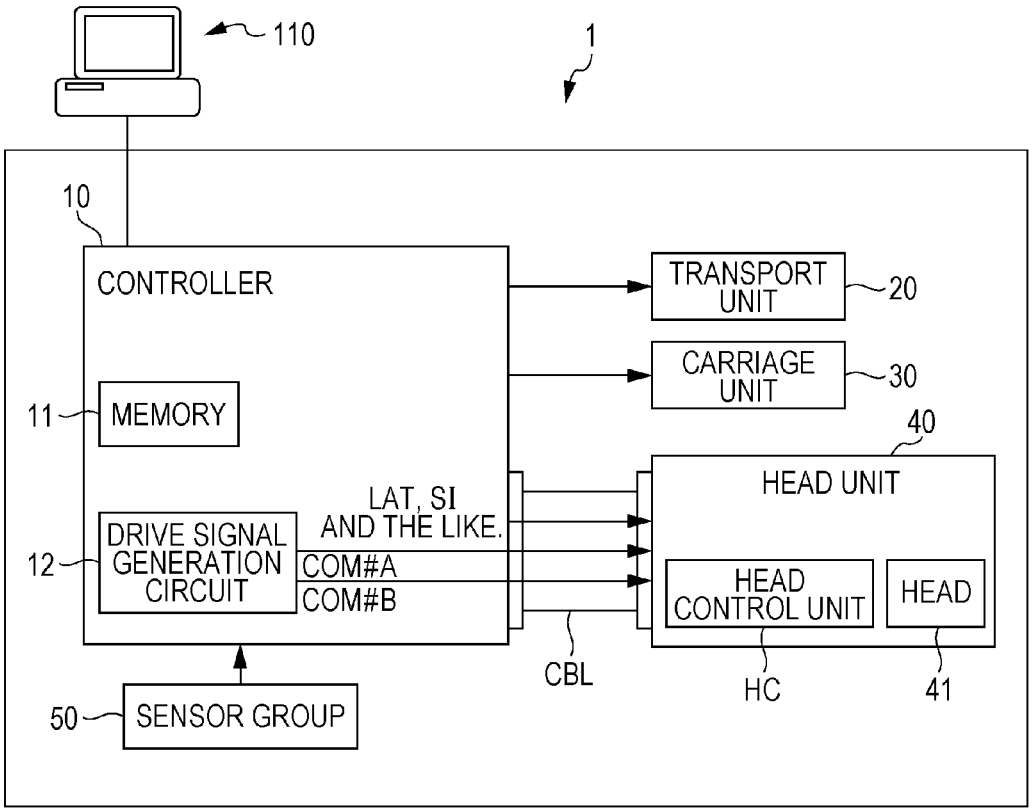
FIG. 1 is a block diagram of a configuration of a printer.

By a description in this specification and accompanying drawings, at least the following matters will be apparent.

According to an aspect of the invention, there is provided a semiconductor device which is provided to correspond to each of a plurality of nozzles discharging a liquid and controls a plurality of drive elements causing a liquid to be discharged from each nozzle with an application of a drive signal. The semiconductor device includes a detection circuit which detects a residual vibration signal of the drive element, an output terminal which is provided to correspond to each of the plurality of drive elements, a discharge transistor which is provided to correspond to each of the plurality of drive elements and controls an application of the drive signal to the drive element through the output terminal, and a detection transistor which is provided to correspond to each of the plurality of drive elements and controls an application of the residual vibration signal to the detection circuit through the output terminal, in which the detection transistor is smaller than the discharge transistor in size, and the discharge transistor is disposed between the detection transistor and the output terminal.

In this case, the discharge transistor and the detection transistor can be efficiently laid out, and an increase in a layout area can be suppressed with a smaller size of the detection transistor than the discharge transistor. In addition, the printing transistor with a large size can reduce a current flowing to the detection transistor by receiving a load caused by static electricity. Therefore, it is possible to ensure resistance to applied static electricity.

In the semiconductor device, it is preferable that the plurality of output terminals be disposed in a predetermined direction, the discharge transistor and the detection transistor corresponding to the output terminal be disposed to be aligned in a direction intersecting with the predetermined direction, and a length of the discharge transistor in the direction intersecting with the predetermined direction be longer than a length of the detection transistor.

In this case, it is possible to increase a distance between the detection transistor and the output terminal, and this is advantageous for a layout.

In the semiconductor device, it is preferable that the discharge transistor and the detection transistor be configured as a transfer gate with an N-type transistor and a P-type transistor, respectively, and that the N-type transistors, the P-type transistors, or both the N-type transistors and the P-type transistors of the discharge transistor and the detection transistor be formed in a common well.

In this case, it is possible to achieve a reduction in a layout area.

In the semiconductor device, it is preferable that the discharge transistor and the detection transistor be configured as a transfer gate with the N-type transistor and the P-type transistor, respectively, and that both the N-type transistor and the P-type transistor which configure the discharge transistor be disposed between the N-type transistor and the P-type transistor which configure the detection transistor and the output terminal.

In this case, it is possible to ensure resistance to static electricity applied.

In the semiconductor device, it is preferable that a resistor be provided between the detection transistor and the output terminal corresponding to the detection transistor.

In this case, it is possible to perform a protection on a static electricity from the output terminal.

According to another aspect of the invention, there is provided a liquid discharge head which causes a liquid to be discharged from each nozzle by applying a drive signal to a plurality of drive elements provided to correspond to each of a plurality of nozzles discharging a liquid. The liquid discharge head includes a semiconductor device which includes a detection circuit that detects a residual vibration signal of the drive element, an output terminal that is provided to correspond to each of the plurality of drive elements, a discharge transistor that is provided to correspond to each of the plurality of drive elements and controls an application of the drive signal to the drive element through the output terminal, and a detection transistor that is provided to correspond to each of the plurality of drive elements and controls an application of the residual vibration signal to the detection circuit through the output terminal, and which controls the plurality of drive elements performing the liquid discharge operation in each nozzle, in which the detection transistor is smaller than the discharge transistor in size, and the discharge transistor is disposed between the detection transistor and the output terminal.

According to still another aspect of the invention, there is provided a liquid discharge apparatus which causes a liquid to be discharged from each nozzle by applying a drive signal to a plurality of drive elements provided to correspond to each of the plurality of nozzles discharging a liquid. The liquid discharge apparatus includes a semiconductor device that includes a detection circuit which detects a residual vibration signal of the drive element, an output terminal which is provided to correspond to each of the plurality of drive elements, a discharge transistor which is provided to correspond to each of the plurality of drive elements and controls an application of the drive signal to the drive element through the output terminal, a detection transistor which is provided to correspond to each of the plurality of drive elements and controls an application of the residual vibration signal to the detection circuit through the output terminal, and which controls the plurality of drive elements performing a liquid discharge operation in each nozzle, in which the detection transistor is smaller than the discharge transistor in size, and the discharge transistor is disposed between the detection transistor and the output terminal.

In a following embodiment, a case of applying a semiconductor device of the invention to an ink jet printer (a printer 1) as a liquid discharge apparatus will be described as an example.

First Embodiment

Basic Configuration of Printer

First, a configuration of a printer 1 which includes a semiconductor device of the present embodiment (semiconductor chip IC: head controller HC to be described) will be described.

Figure 2:
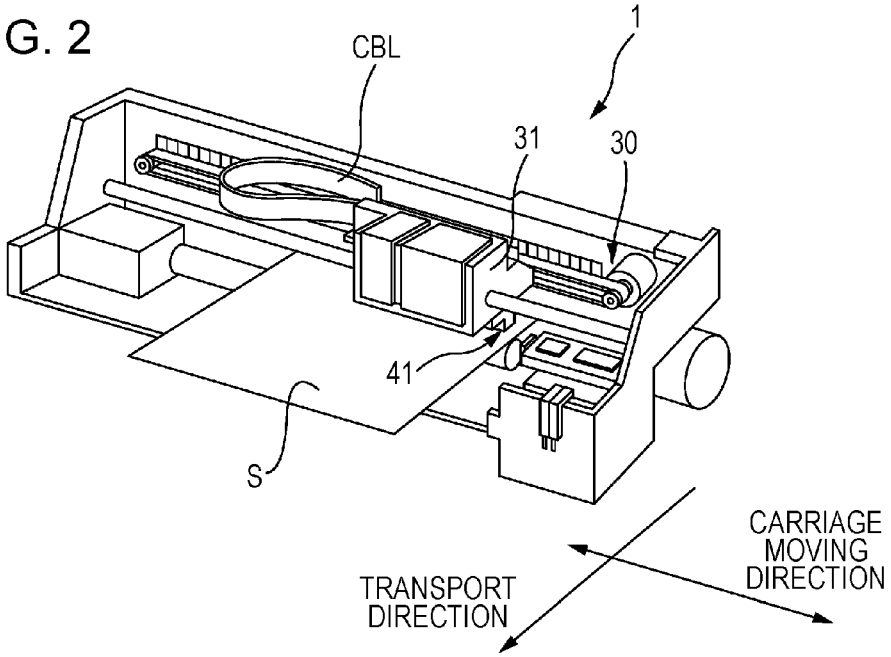
FIG. 2 is a perspective view of the printer.

FIG. 1 is a block diagram of a configuration of the printer 1. FIG. 2 is a perspective view of the printer 1.

The printer 1 includes a controller 10, a transport unit 20, a carriage unit 30, a head unit 40, and a sensor group 50. The printer 1 which receives print data from a computer 110 that is a print control device controls each unit using the controller 10.

The controller 10 is a control device for performing a control of the printer 1. The controller 10 controls each unit according to a program stored in a memory 11. In addition, the controller 10 controls each unit based on the print data received from the computer 110, and prints an image on a medium S. Various types of detection signals detected by the sensor group 50 are input into the controller 10.

The controller 10 includes a drive signal generation circuit 12. The drive signal generation circuit 12 generates drive signals (a first drive signal COM#A, a second drive signal COM#B) for driving a piezo element (to be described). The drive signal generated by the drive signal generation circuit 12 or a drive of the piezo element will be described below.

The transport unit 20 is a mechanism for transporting a medium S (for example, paper, film, and the like) in a transport direction. The transport direction is a direction which intersects with a moving direction of a carriage 31.

The carriage unit 30 is a mechanism for moving the carriage 31 in the moving direction. The carriage 31 can reciprocally move in the moving direction. A head 41 of the head unit 40 is provided in the carriage 31.

The head unit 40 is intended to discharge an ink onto the medium S. The head unit 40 includes the head 41 and a head controller HC for controlling the head 41. Various types of signals which are needed to control the head 41 are transmitted to the head unit 40 through a cable CBL from the controller 10.

Figure 3:
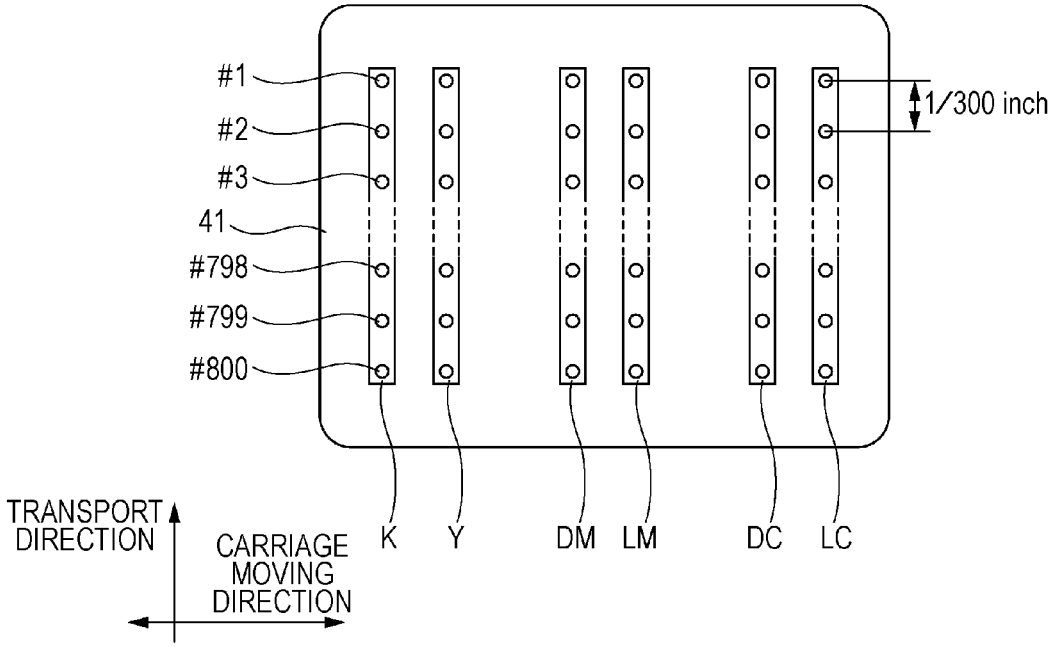
FIG. 3 is a diagram of a head viewed from a bottom.

FIG. 3 is a diagram of the head 41 viewed from a bottom. The head 41 includes nozzle rows of six colors (black K, yellow Y, dark magenta DM, light magenta LM, dark cyan DC, light cyan LC). The six nozzle rows are aligned in the moving direction of the carriage 31. Each nozzle row includes 800 nozzles which are discharge ports for discharging an ink. The 800 nozzles are aligned at sections of 1/300 inch (300 dpi) in the transport direction.

Figure 4:
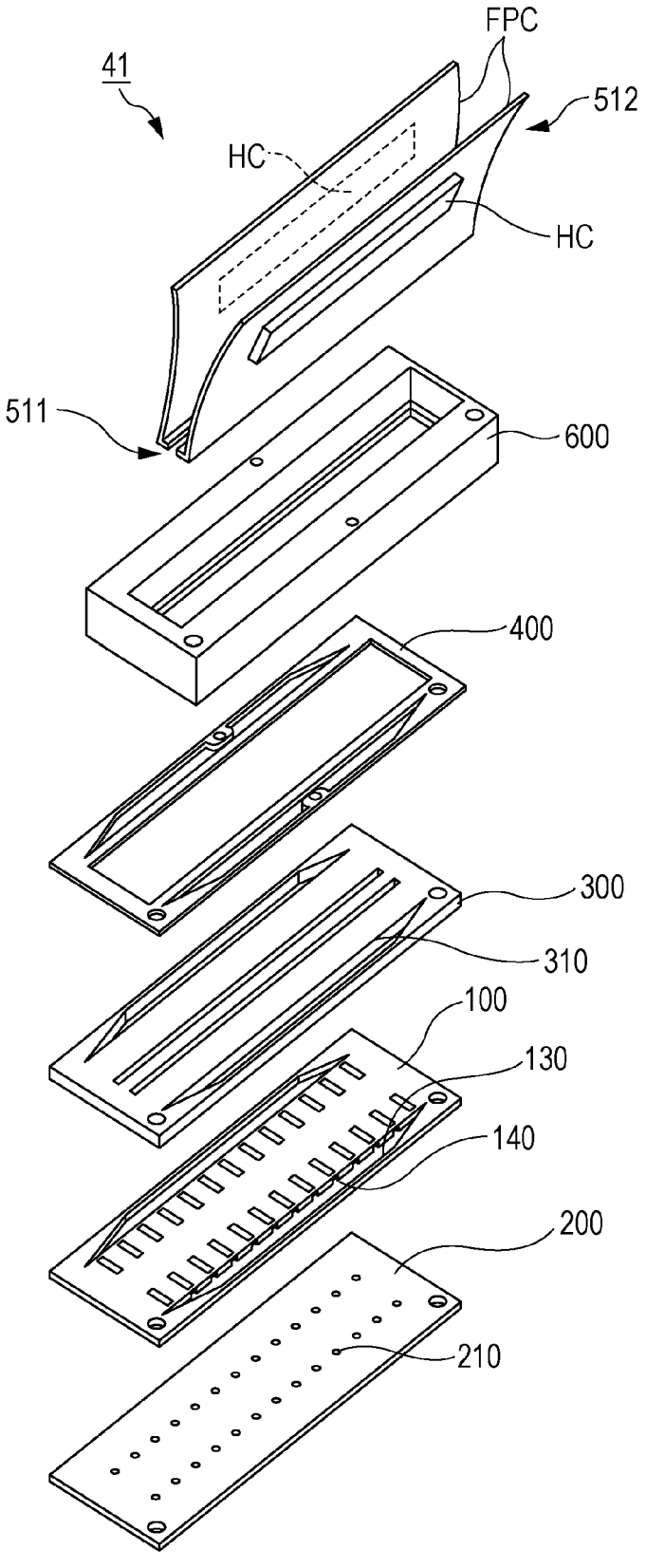
FIG. 4 is an exploded perspective view of the head.
Figure 5:
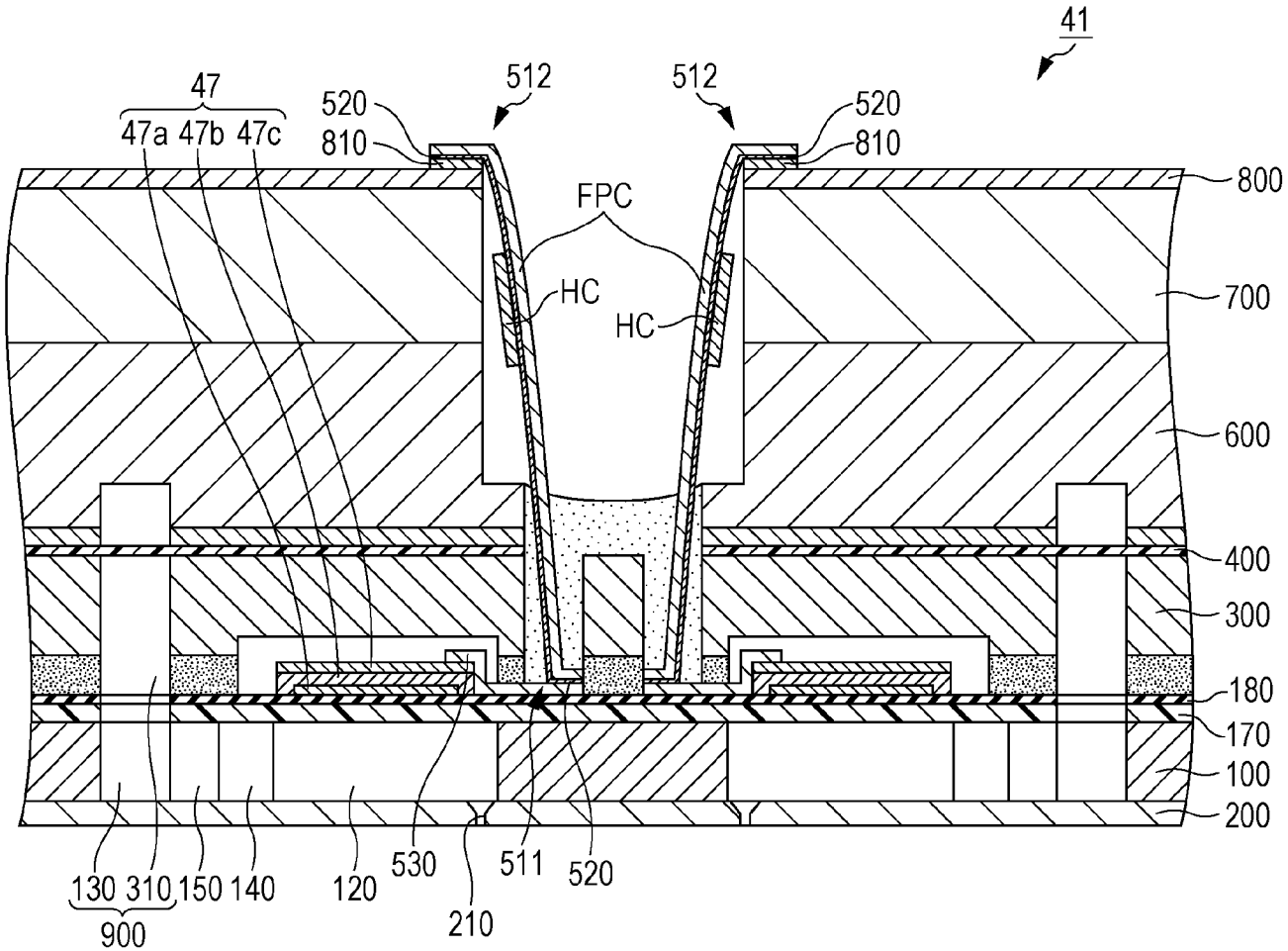
FIG. 5 is a schematic cross-sectional view for describing an internal configuration of the head.

FIG. 4 is an exploded perspective view of the head 41. FIG. 5 is a schematic cross-sectional view for describing an internal configuration of the head 41. The head 41 includes a flexible printed circuit board FPC and a head controller HC which is a semiconductor device (semiconductor chip IC).

The head 41 includes a flow path forming substrate 100, a nozzle plate 200, a protection substrate 300, and a compliance substrate 400. The flow path forming substrate 100, the nozzle plate 200, and the protection substrate 300 are stacked so as to interpose the flow path forming substrate 100 between the nozzle plate 200 and the protection substrate 300, and the compliance substrate 400 is provided on the protection substrate 300. Furthermore, a case head 600 which is a holding member is provided on the compliance substrate 400, and a holder member 700 and a relay substrate 800 are provided on the case head 600.

A plurality of pressure generating chambers 120 divided by partitions are provided in two rows parallel in the width direction on the flow path forming substrate 100. Here, the pressure generating chambers 120 are provided in pairs.

In addition, a communication portion 130 is formed in a region outside the pressure generating chamber 120 of each row in a longitudinal direction, and the communication portion 130 and each pressure generating chamber 120 communicate with each other through an ink supply path 140 and a communication path 150 provided in each pressure generating chamber 120. The communication portion 130 communicates with a reservoir portion 310 of the protection substrate 300 to configure a portion of a manifold 900 which is a common ink chamber for each row of the pressure generating chamber 120. The ink supply path 140 is formed in a narrower width than the pressure generating chamber 120, and constantly holds path resistance of an ink flowing into the pressure generating chamber 120 from the communication portion 130.

On the other hand, an elastic film 170 is formed on a side opposite to an opening surface of the flow path forming substrate 100, and an insulation film 180 is formed on the elastic film 170. Furthermore, a lower electrode 47*a* made of a metal such as platinum (Pt) or a metal oxide such as strontium ruthenate (SrRuO), a piezoelectric layer 47*b* having a perovskite structure, and an upper electrode 47*c* made of a metal such as Au or Ir are formed on the insulation film 180 to configure a piezo element 47 as a pressure generating element. Here, the piezo element 47 refers to a portion which includes the lower electrode 47*a*, the piezoelectric layer 47*b*, and the upper electrode 47*c*. The piezo element 47 corresponds to the pressure generating chamber 120 to forms a pair.

The flexible printed circuit board FPC includes a first end 511, and a second end 512 positioned opposite to the first end 511. The first end 511 of the flexible printed circuit board FPC is inserted into the protection substrate 300, and the second end 512 is connected to the relay substrate 800. The first end 511 is disposed toward the piezo elements 47 facing each other.

The flexible printed circuit board FPC is a board having flexibility, and the first end 511 is bent in a substantial L-shape so that an internal angle θ becomes an obtuse angle. It is preferable that the internal angle θ be equal to or greater than 95° and less than 110°. A wiring 520 of the flexible printed circuit board FPC on the first end 511 side is electrically connected to the upper electrode 47*c* of the piezo element 47 through a lead electrode 530. The wiring 520 of the first end 511 and the lead electrode 530 are joined to each other by using an Anisotropic Conductive Film (ACF) adhesive which is not shown and by applying pressure.

The second end 512 of the flexible printed circuit board FPC passes through a slit of the holder member 700 and a slit of the relay substrate 800. Then, the wiring 520 of the second end 512 is joined to a terminal 810 of the relay substrate 800.

Moreover, the head controller HC is mounted onto the flexible printed circuit board FPC, and each piezo element 47 is driven by the head controller HC.

An ink introduction path (not shown) for supplying an ink from an ink reserving means such as an ink cartridge (not shown) to the manifold 900 is provided in a case head 600.

In such a head 41, an ink is captured from the ink cartridge and an interior from the manifold 900 to a nozzle opening 210 is filled with the ink, and then a voltage is applied between each lower electrode 47*a* and each upper electrode 47*c* corresponding to the pressure generating chamber 120 according to a signal from the head controller HC. By an application of the voltage, the elastic film 170 and the piezoelectric layer 47*b* are deformed to be bent, and a pressure in each pressure generating chamber 120 is increased to discharge an ink droplet from the nozzle opening 210.

Figure 6:
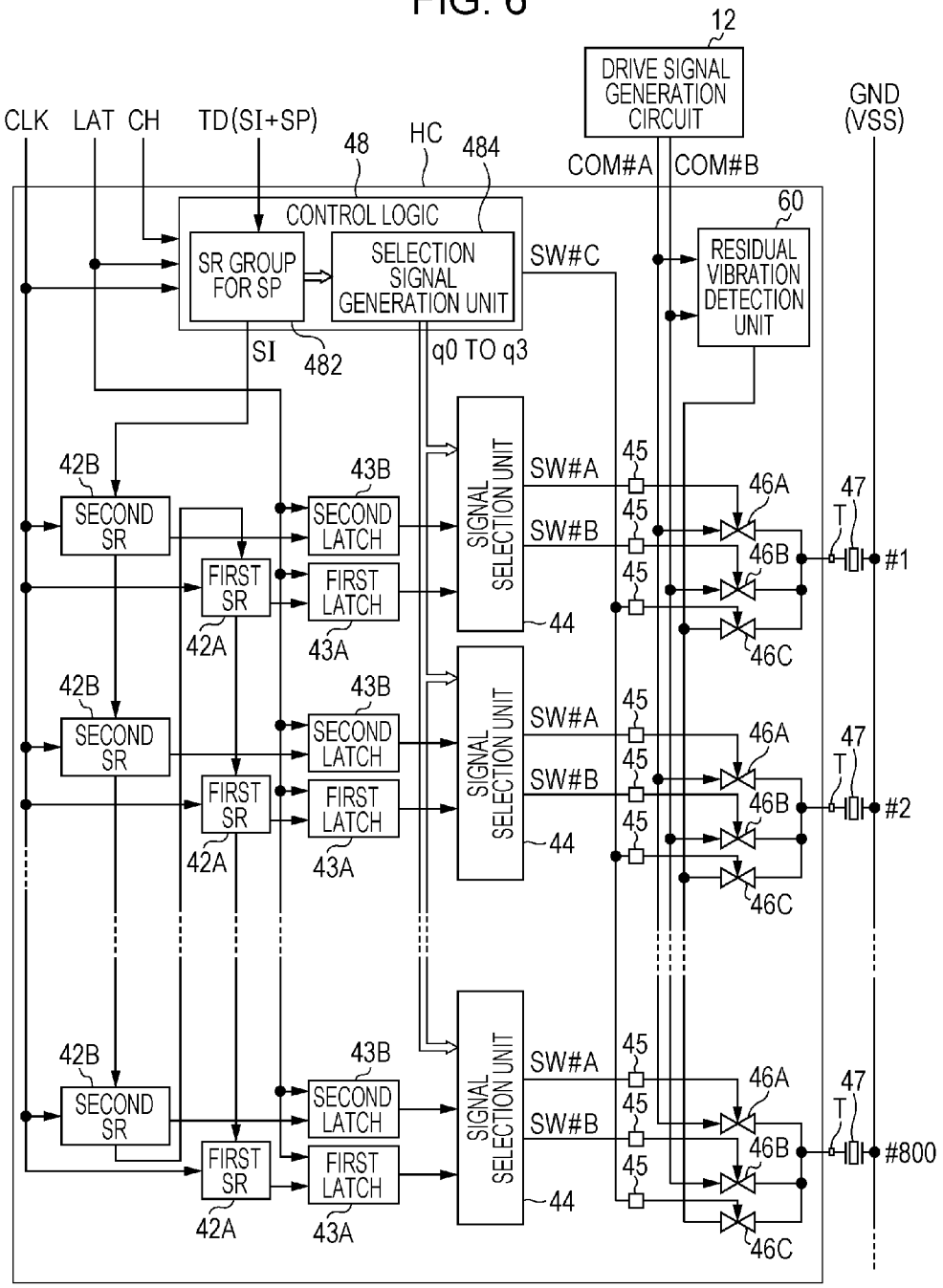
FIG. 6 is a block diagram of a head controller.

FIG. 6 is a block diagram of the head controller HC. A clock CLK, a latch signal LAT, a change signal CH, and a drive signal COM are input to the head controller HC through a cable CBL from a controller 10. Moreover, a setting signal TD configured from pixel data SI and setting data SP is input to the head controller HC through the cable CBL from the controller 10.

The head controller HC respectively is provided in each color of the nozzle group (refer to FIG. 3). The head controllers HC for each color of the nozzle group all have a common configuration.

The head controller HC includes a shift register 42 (a first shift register 42A and a second shift register 42B), a latch circuit 43 (a first latch circuit 43A and a second latch circuit 43B), a signal selection unit 44, a level shift circuit 45, a switch 46 (a printing switch 46A, a printing switch 46B, and a detection switch 46C), a control logic 48, and a residual vibration detection unit 60. Each portion except for the control logic 48 and the residual vibration detection unit 60 (that is, the shift register 42, the latch circuit 43, the signal selection unit 44, the level shift circuit 45, and the switch 46) is respectively provided in each piezo element 47 (each nozzle). The control logic 48 includes a shift register group 482 for storing the setting data SP and a selection signal generation unit 484 which generates selection signals q0 to q3 based on the setting data SP.

When a setting signal TD is synchronized with the clock CLK and is input to the head controller HC, the pixel data SI included in the setting signal are respectively set to the first shift register 42A and the second shift register 42B, and the setting data SP are set in a shift register group 482 of the control logic 48. Pixel data of two bits are assigned to each nozzle, a lower bit of the pixel data of two bits respectively corresponding to each nozzle, is set in the first shift register 42A, and an upper bit of the pixel data of two bits is set in the second shift register 42B.

Then, in response to a pulse (refer to FIG. 7) of the latch signal LAT, the pixel data of two bits are latched to the first latch circuit 43A and the second latch circuit 43B, and the setting data SP are latched to the selection signal generation unit 484. The lower bit of the pixel data of two bits respectively corresponding to each nozzle, is latched to the first latch circuit 43A, and an upper bit of the pixel data of two bits is latched to the second latch circuit 43B.

Figure 7:
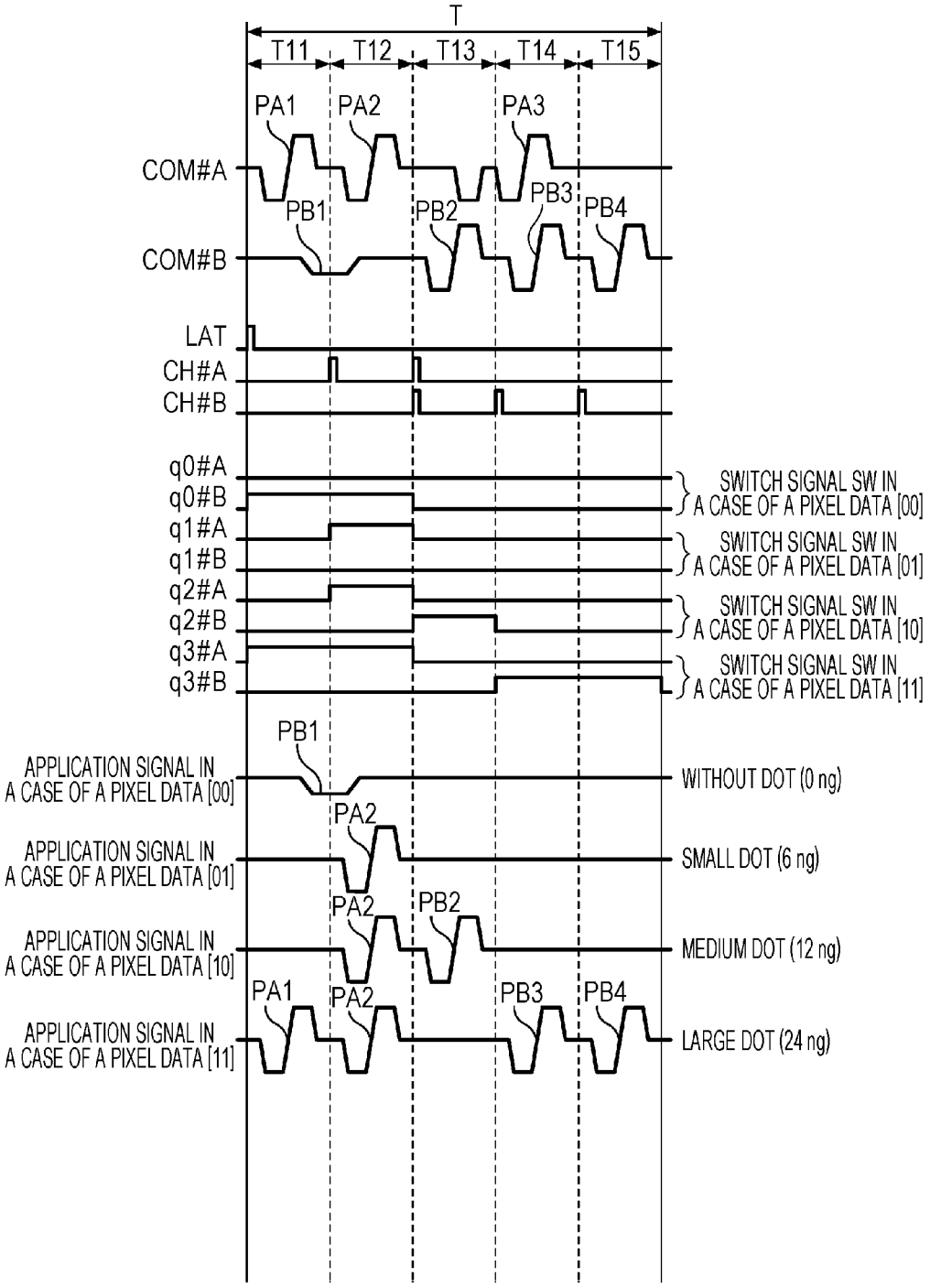
FIG. 7 is an explanatory diagram of various signals.

FIG. 7 is an explanatory diagram of various types of signals.

Two drive signals COMs (a first drive signal COM#A, a second drive signal COM#B) are signals input to the head controller HC from the drive signal generation circuit 12. The drive signal COM is repeatedly generated in each repetition period T. The repetition period T is a period required for the carriage 31 to move a distance corresponding to one pixel. Whenever the carriage 31 moves a predetermined distance, a drive signal COM of the same waveform is repeatedly generated from the drive signal generation circuit 12.

Here, the repetition period T can be divided into five sections T11 to T15. The drive signal COM includes a plurality of drive pulses for each repetition period T. The first drive signal COM#A includes a drive pulse PA1 of a first section T11, a drive pulse PA2 of a second section T12, and a drive pulse PA3 of a third sections T13 to a fifth section T15. The second drive signal COM#B includes a drive pulse PB1 of the first section T11 and the second section T12, a drive pulse PB2 of the third section T13, a drive pulse PB3 of a fourth section T14, and a drive pulse PB4 of the fifth section T15. A waveform of each drive pulse is determined based on an operation to be performed in the piezo element.

The latch signal LAT is a signal which shows a start timing of the repetition period T. A change signal CH (a first change signal CH#A, a second change signal CH#B) is a signal which shows a section of a drive pulse included in the drive signal COM.

Selection signals q0 to q3 are signals output from the selection signal generation unit 484 (refer to FIG. 6). Each selection signal is configured from a pair of signals (a first selection signal q#A and a second selection signal q#B), and A or B is given to each signal as a subscript in FIG. 7. The selection signals q0 to q3 are binary signals which shows an H level or a L level in five sections T11 to T15 of the repetition period T based on the setting data SP latched to the selection signal generation unit 484.

The selection signals q0 to q3 are input to the signal selection unit 44 (refer to FIG. 6). The signal selection unit 44 selects any selection signal q of the selection signals q0 to q3 according to the pixel data of two bits latched to the first latch circuit 43A and the second latch circuit 43B. A selection signal q0 (q0#A, q0#B) is selected when the pixel data are [00], a selection signal q1 is selected when the pixel data are [01], a selection signal q2 is selected when the pixel data are [10], and a selection signal q3 is selected when the pixel data are [11]. The selected selection signal is output from the signal selection unit 44 as a switch signal SW.

As shown in FIG. 6, two printing switches 46 (a printing switch 46A and a printing switch 46B) are respectively provided in each piezo element 47. The first drive signal COM#A is input to the printing switch 46A, and the second drive signal COM#B is input to the printing switch 46B. The signal selection unit 44 outputs two switch signals SW (a first switch signal SW#A and a second switch signal SW#B) according to a pair of signals configuring a selection signal, the first switch signal SW#A is input to the printing switch 46A, and the second switch signal SW#B is input to the printing switch 46B.

When a switch signal is at an H level, the switch 46 is in an on state, and the drive signal COM is applied to the piezo element 47. When the switch signal SW is at an L level, the switch 46 is in an off state, and the drive signal COM is not applied to the piezo element 47.

As a result, when the pixel data are [00], a drive pulse PB1 of the first section T11 and the second section T12 of the second drive signal COM#B is applied to the piezo element 47. When the piezo element 47 is driven according to the drive pulse PB1, pressure fluctuation to an extent that ink is not discharged is generated in ink, and an ink meniscus (free surface of an ink exposed at a nozzle portion) slightly vibrates. In this case, a dot is not formed on the medium S.

When the pixel data are [01], a drive pulse PA2 of the second section T12 of the first drive signal COM#A is applied to the piezo element 47. When the piezo element 47 is driven according to the drive pulse PA2, a small amount of an ink (herein, 6 ng) is discharged and a small dot is formed on the medium S.

When the pixel data are [10], the drive pulse PA2 of the second section T12 of the first drive signal COM#A and the drive pulse PB2 of the third section T13 of the second drive signal COM#B are applied to the piezo element 47. When the piezo element 47 is driven according to the drive pulse PA2 and the drive pulse PB2, a medium amount of an ink (herein, 12 ng) is discharged and a medium dot is formed on the medium S.

When the pixel data are [11], the drive pulse PA1 of the first section T11 and the drive pulse PA2 of the second section T12 of the first drive signal COM#A, the drive pulse PB3 of the fourth section T14 and the drive pulse PB4 of the fifth section T15 of the second drive signal COM#B are applied to the piezo element 47. Accordingly, a maximum amount of an ink (herein, 24 ng) is discharged, and a large dot (the largest dot) is formed on the medium S.

The residual vibration detection unit 60 (corresponding to a detection circuit) detects a state (poor nozzle and the like) of a nozzle by detecting a residual vibration signal of the piezo element 47 after an application of the drive signals. A configuration of the residual vibration detection unit 60 will be described later. The detection switch 46C is provided between the residual vibration detection unit 60 and each piezo element 47. The detection switch 46C is controlled to be turned on or off by a detection switch signal SW#C output from the control logic 48.

The level shift circuit 45 is provided in each supply line of the first switch signal SW#A, the second switch signal SW#B, and the detection switch signal SW#C. The level shift circuit 45 is intended to convert a level of a signal from a low voltage system (e.g., 3 V) to a high voltage system (e.g., 42 V).

Residual Vibration Detection Unit 60

Figure 8:
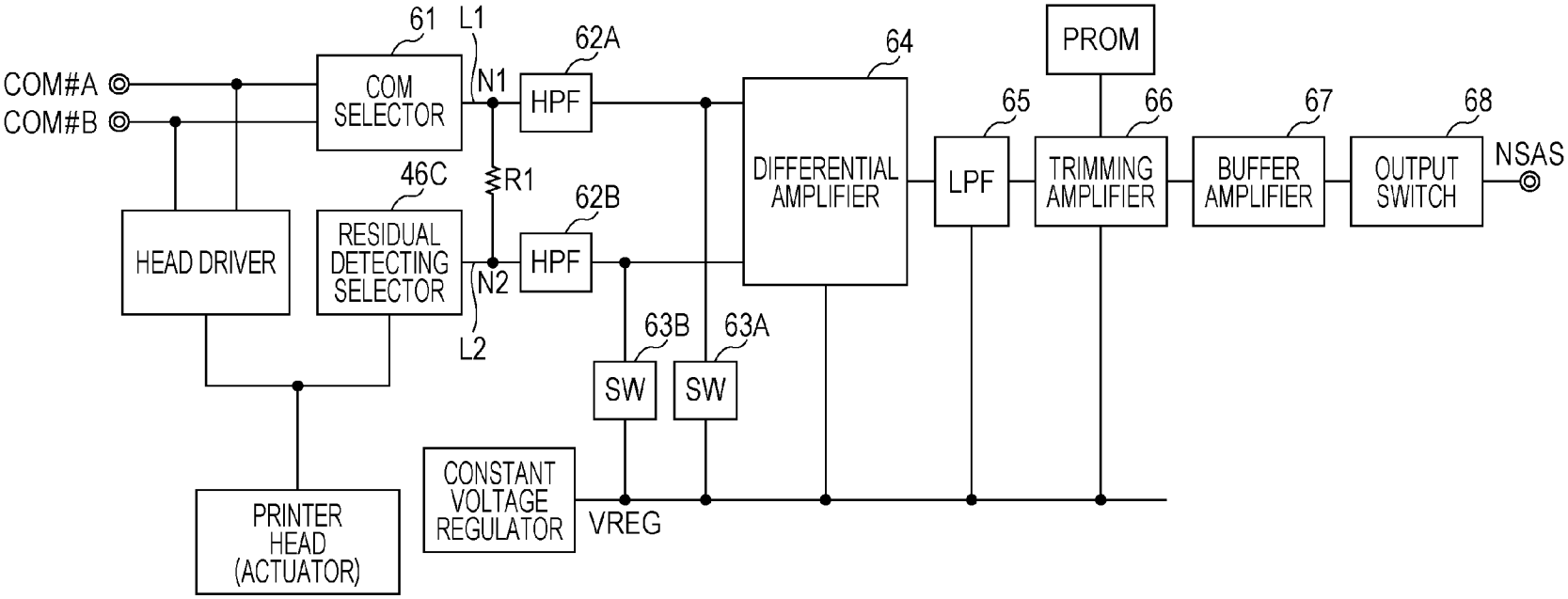
FIG. 8 is a block diagram of a residual vibration detection unit.
Figure 9:
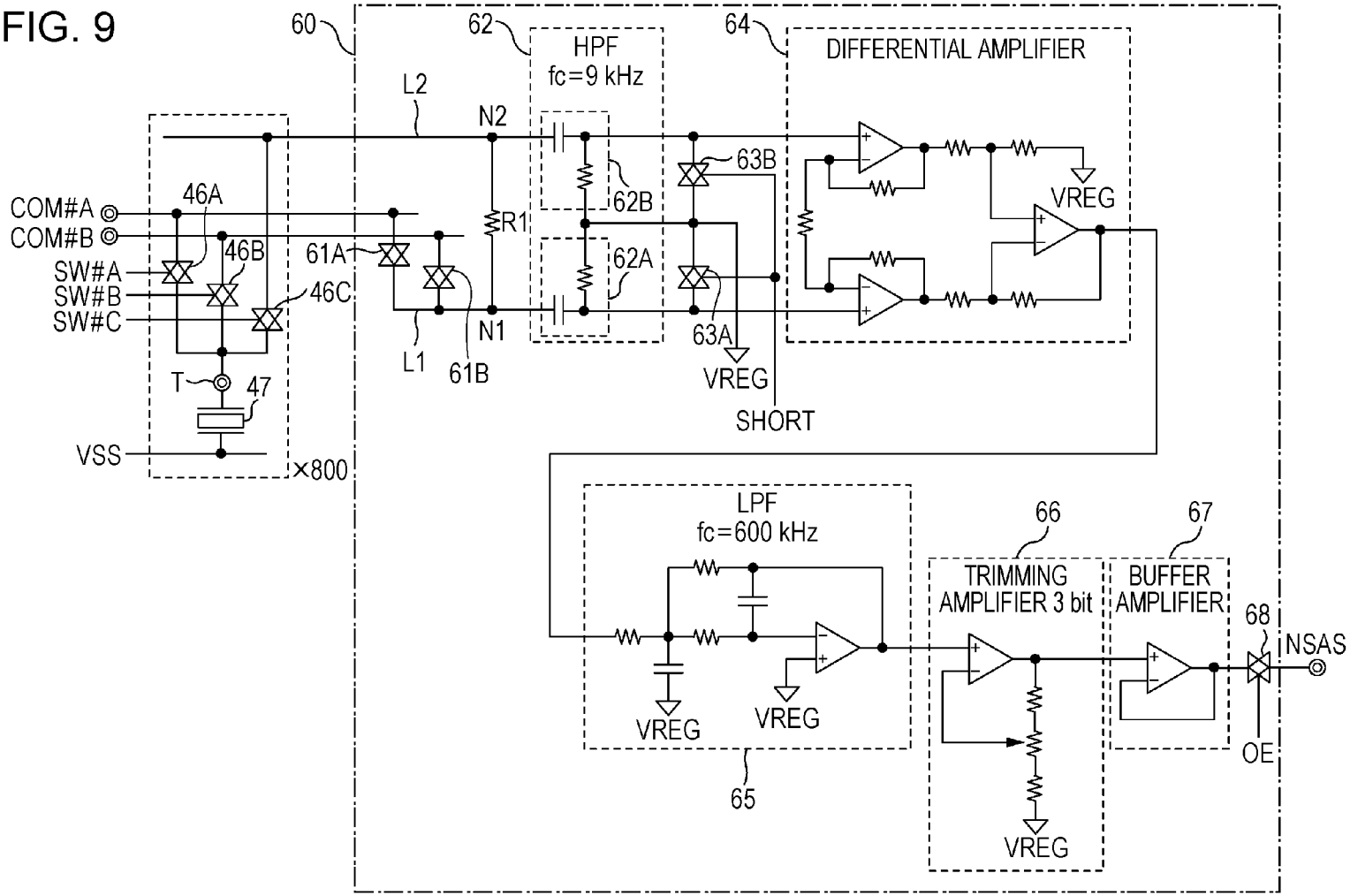
FIG. 9 is a circuit diagram of FIG. 8.

FIG. 8 is a block diagram of a residual vibration detection unit 60, and FIG. 9 is a circuit diagram of FIG. 8.

The residual vibration detection unit 60 includes a COM selector 61, a bias resistor R1, high pass filters (HPF) 62A and 62B, switches 63A and 63B, a differential amplifier (AMP) 64, a low pass filter (LPF) 65, a trimming amplifier 66, a buffer amplifier 67, and an output switch 68.

In a head driver shown in FIG. 8, printing switches 46A and 46B of FIG. 9 are included, and the detection switch 46C is included in a residual detection selector. In addition, the piezo element 47 of FIG. 9 is included in a printer head (actuator) of FIG. 8. The printing switch 46A, the printing switch 46B, the detection switch 46C, and the piezo element 47 are respectively provided to correspond to each nozzle (800 nozzles in the embodiment) of the head 41. Moreover, a portion excluding the piezo element 47 is provided in the head controller HC, and an output terminal T from the head controller HC to each piezo element 47 is provided to correspond to each nozzle. A configuration of a portion corresponding to one nozzle is shown in FIG. 9.

As shown in FIG. 9, three switches are provided in parallel through the output terminal T for one piezo element 47.

The printing switch 46A controls an application of the first drive signal COM#A to the piezo element 47 through the output terminal T. The printing switch 46A is controlled to be turned on or off by the first switch signal SW#A.

The printing switch 46B controls an application of the second drive signal COM#B to the piezo element 47 through the output terminal T. The printing switch 46B is controlled to be turned on or off by the second switch signal SW#B.

The detection switch 46C controls an application of a residual vibration signal to the residual vibration detection unit 60 (more specifically, a second line L2 of the residual vibration detection unit 60) through the output terminal T.

Each of these switches (printing switch 46A, printing switch 46B, detection switch 46C), as described below, is configured as a transfer gate with P-type and N-type transistors (also referred to as a transmission gate). In addition, another switch to be described below is configured to as a transfer gate. However, a configuration of each switch is not limited to the transfer gate; and each switch may have another configuration. For example, each switch may be configured to have any one of the channel transistors.

A COM selector 61 includes a switch 61A and a switch 61B.

The switch 61A is provided between a supply line of the first drive signal COM#A and a first line L1 of the residual vibration detection unit 60.

The switch 61B is provided between a supply line of the second drive signal COM#B and the first line L1.

The bias resistor R1 is provided between a second line L2 (node N2) and the first line L1 (node N1).

The high pass filter 62 includes a first high pass filter 62A provided in the first line L1, and a second high pass filter 62B provided in the second line L2. Each high pass filter is respectively configured to have a capacitor and a resistor.

Then, the high pass filter 62 sets a signal of the second line L2 connected to the detection switch 46C and a signal of the first line L1 to which a drive signal (the first drive signal COM#A, the second drive signal COM#B) is supplied to be input signals in a differential form, and outputs a signal obtained by attenuating each low frequency component in the first high pass filter 62A and the second high pass filter 62B to the differential amplifier 64. By attenuating the low pass frequency component, it is possible to improve a detection accuracy of residual vibration. Furthermore, the high pass filter 62 (the first high pass filter 62A, the second high pass filter 62B) respectively cuts a DC component of a signal of the first line L1 and the second line L2 using a capacitor.

The switch 63A is provided in parallel with a resistor of the first high pass filter 62A. In addition, the switch 63B is provided in parallel with a resistor of the second high pass filter 62B. Moreover, the switch 63A and the switch 63B are switched to be turned on or off at the same time.

The differential amplifier 64 is an instrumentation amplifier which is configured using three operational amplifiers, and has a high common mode rejection ratio. Accordingly, although common mode noises are mixed in the first line L1 and the second line L2, it is possible to suppress the common mode noises.

The low pass filter 65 attenuates a high frequency component of an output of the differential amplifier 64. The low pass filter 65 in this example is a multiple feedback type using an operational amplifier. However, if it is possible to attenuate the high frequency component more than a frequency band of the residual vibration, the low pass filter may be of any type. Accordingly, noise components can be removed.

The trimming amplifier 66 performs a gain adjustment of an output of the low pass filter 65.

The buffer amplifier 67 performs a impedance conversion and outputs a signal of low impedance. The buffer amplifier 67 in this example is configured to have a voltage follower using the operational amplifier.

The output switch 68 is intended to switch an output of a signal from the buffer amplifier 67 between on and off. For example, the output switch 68 switches an output of the residual vibration detection unit 60 provided in each nozzle of the head 41.

When detecting a state of a nozzle, first, a drive signal is applied to the piezo element 47 to detect a residual vibration. When applying the first drive signal COM#A to the piezo element 47, the printing switch 46A is turned on, and the printing switch 46B and the detection switch 46C are turned off. In addition, the switches 61A and 61B are turned off, and the switches 63A and 63B are turned on at this time.

Then, when detecting a residual vibration after a pulse (for example, a detection pulse which does not actually discharge an ink) of the first drive signal COM#A is applied to the piezo element 47, the detection switch 46C is turned on and the printing switch 46A is turned off. Furthermore, the switch 61A is turned on, and the switches 63A and 63B are turned off.

Accordingly, an electromotive force signal (residual vibration signal) generated in the piezo element 47 after the first drive signal COM#A is applied is transmitted in a path from the detection switch 46C to the second line L2, and then to the second high pass filter 62B. At this time, since the printing switch 46A is turned off and the switch 61A is turned on, the first drive signal COM#A is supplied to the first line L1 and a potential of a node N2 is biased to a predetermined potential of the first drive signal COM#A by the bias resistor R1. Signals of the first line L1 and the second line L2 are input to the differential amplifier 64 through the first high pass filter 62A and the second high pass filter 62B, respectively.

Then, signals in a single-ended form in which common mode noises are suppressed from two input signals are output by the differential amplifier 64. Furthermore, this signal is output to, for example, an abnormality determination unit (not shown) provided in the controller 10 through the output switch 68 after a high frequency component is attenuated in the low pass filter 65 and is gain-adjusted by the trimming amplifier 66, and impedance is converted by the buffer amplifier. Then, a state of a nozzle is determined based on a frequency, an amplitude, a phase, and the like of a signal detected by the residual vibration detection unit 60 in the abnormality detection unit. The abnormality determination unit may be provided in the residual vibration detection unit 60.

The residual vibration detection unit 60 detects a state of a nozzle based on a residual vibration signal generated in the piezo element 47 after a drive signal is applied.

As shown in FIG. 9 (and FIG. 6), the detection switch 46C is provided on the same side as the printing switches 46A and 46B viewed from the piezo element 47 in the embodiment (the printing switches 46A and 46B and the detection switch 46C are disposed in parallel on the same side as viewed from the piezo element 47). In addition, the printing switches 46A and 46B and the detection switch 46C are provided in the same semiconductor chip (head controller HC) in the embodiment.

When detecting a residual vibration of an electrode on a GND (VSS) side of the piezo element 47, a detection switch 46C is provided in an electrode on an opposite side to an electrode on an application side of the drive signal of the piezo element 47. In other words, the detection switch 46C is provided on an opposite side to the printing switches 46A and 46B viewed from the piezo element 47. Therefore, a semiconductor chip in which the detection switch 46C is provided becomes separated from a semiconductor chip (head controller HC) in which the printing switches 46A and 46B are provided. In contrast, in the embodiment, since the detection switch 46C is provided on the same side as a printing switch viewed from the piezo element 47, the detection switch 46C can be disposed in the same semiconductor device as are the printing switches 46A and 46B.

Head Controller HC (Semiconductor Device)

Figure 10:
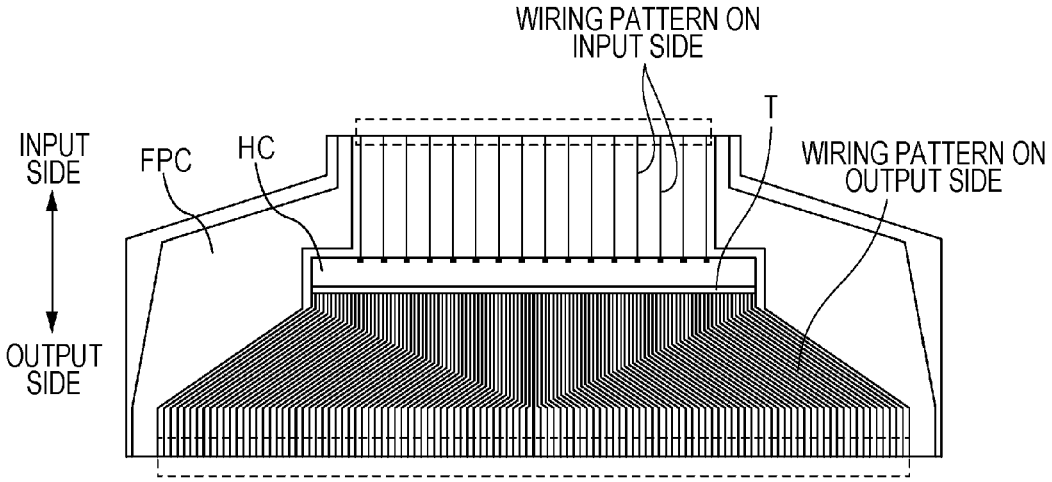
FIG. 10 is an explanatory diagram of a wiring pattern of a head controller and a flexible printed circuit board (FPC).

FIG. 10 is an explanatory diagram of a wiring pattern of the head controller HC and the flexible printed circuit board (FPC).

The output terminal T is disposed on an output side of the head controller HC. The output terminal T is provided in a number (herein, 800) as great as that corresponding to the number of piezo elements (the number of nozzles) so as to output a signal to be applied to a number of piezo elements 47. Therefore, the head controller H is in a rectangular shape, and a large number of output terminals T are aligned in a long side of an output side. In other words, a direction in which the output terminals T are aligned is a direction of a long side of the head controller HC of a rectangular shape. The output terminal T of the head controller HC is electrically connected to a wiring on an output side of the flexible printed circuit board FPC.

An input terminal is disposed on a long side of an input side of the head controller HC. The clock signal CLK, the latch signal LAT, the change signal CH, the setting signal TD configured from the pixel data SI and setting data SP, and the like are input to the head controller HC as an input signal. A wiring pattern on an input side of the flexible printed circuit board FPC is electrically connected to an input terminal of the head controller HC.

A long side direction of the head controller HC of a rectangular shape is parallel to a nozzle row direction (refer to FIG. 3) in which nozzles are aligned. On the other hand, the output terminal T of the head controller HC is disposed in the long side direction of the head controller HC. For this reason, a direction in which the output terminals T of the head controller HC are aligned in parallel to the nozzle row direction in which nozzles are aligned.

Figure 11A:
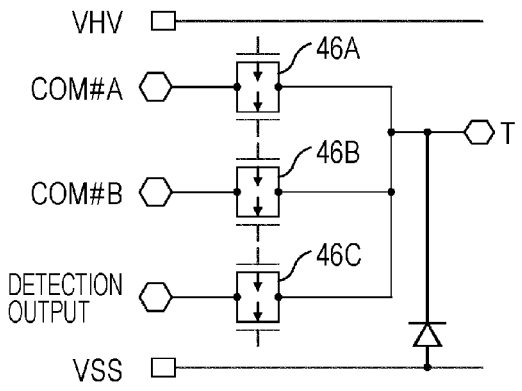
FIG. 11A is a circuit diagram of a periphery of an output terminal.
Figure 11B:
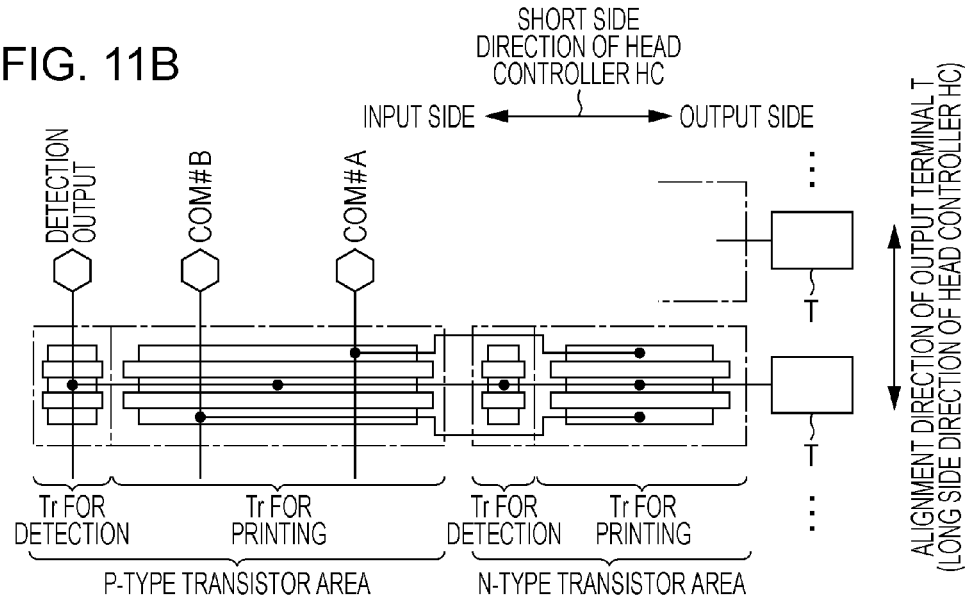
FIG. 11B is a layout diagram of the periphery of an output terminal. Moreover.

FIG. 11A is a circuit diagram of a periphery of the output terminal T, and FIG. 11B is a layout diagram of the periphery of the output terminal T. Moreover, FIG. 11C is a cross-sectional view which shows a structure of a switch (printing switches 46A and 46B).

As shown in FIG. 11A, in the present embodiment, the printing switch 46A, the printing switch 46B, and the detection switch 46C are disposed in parallel with respect to the output terminal T (In other words, piezo element 47).

As shown in FIG. 11A, the printing switch 46A and the printing switch 46B are configured to have a transfer gate made of an N channel-type MOSFET (hereinafter, referred to as an N-type transistor) and a P channel-type MOSFET (hereinafter, referred to as a P-type transistor). In a following description, these transistors which configure a printing switch are referred to as a printing transistor (corresponding to a discharge transistor). In addition, the detection switch 46C is also configured from the transfer gate made of the N-type transistor and the P-type transistor in the same manner.

Figure 11C:
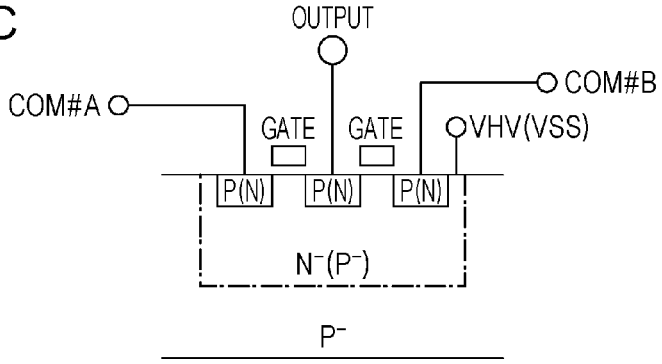
FIG. 11C is a cross-sectional view which shows a structure of a switch (printing switches).

A configuration of a region of the P-type transistor of the printing switch 46A and the printing switch 46B (a cross-section of a printing transistor portion of the P-type transistor area in FIG. 11B) is conceptually shown in FIG. 11C. An N-type transistor area also has a configuration the same as the P-type transistor area, and an inside parentheses in FIG. 11C shows a configuration of the N-type transistor area.

As shown in FIG. 11C, the P-type transistor of the printing switches 46A and 46B is formed in a formation region (N-well) of the P-type transistor surrounded by a chain line, and a supply voltage (VHV) is applied to the N-well. As shown in FIG. 11B, an N-well of the printing transistor is formed continuously with an N-well of the detection transistor (P-type transistor). In other words, the P-type transistor of each of the printing transistor and the detection transistor is formed in a common N-well. Moreover, in the same manner, the N-type transistor of each of the printing transistor and the detection transistor is formed in a common P-well for a formation region (P-well) of the N-type transistor. Accordingly, it is possible to more efficiently lay out the printing transistor and the detection transistor, and to achieve a reduction in area.

A common P-type diffusion layer in two P-type transistors shown in FIG. 11C is connected to the output terminal T which is an output electrode. Among the two P-type transistors shown in FIG. 11C, one with an input of the first drive signal COM#A is a P-type transistor for the printing switch 46A, and an inverted signal of the switch signal SW#A is applied to the control electrode (gate). Then, when the P-type transistor is turned on, the first drive signal COM#A is output to the output terminal T. One having an input of the second drive signal COM#B is a P-type transistor for the printing switch 46B, and an inverted signal of the switch signal SW#B is applied to the control electrode (gate). Then, when the P-type transistor is turned on, the second drive signal COM#B is output to the output terminal T.

In addition, the same is applied for the N-type transistor shown in parentheses in FIG. 11C. In a case of the N-type transistor, a GND voltage (VSS) is applied to the P-well surrounded by a dashed line. A common N-type diffusion layer in two N-type transistors is connected to the output terminal T which is an output electrode. The first drive signal COM#A is applied to one of the two N-type transistors, the switch signal SW#A is applied to the control electrode (gate), and when the N-type transistor is turned on, the first drive signal COM#A is output to the output terminal T. In addition, the second drive signal COM#B is applied to the other of the two N-type transistors, the switch signal SW#B is applied to the control electrode (gate), and when the N-type transistor is turned on, the second drive signal COM#B is output to the output terminal T.

Incidentally, when resistance of each printing transistor configuring the printing switches 46A and 46B increases, it takes time to charge or discharge the piezo element 47, thereby lowering a printing speed. Moreover, when the resistance of the printing transistor increases, a heating value when charging or discharging the piezo element 47 increases, and thereby heating becomes a problem. Therefore, the size (transistor size) of the printing transistor is relatively largely set.

In contrast, the detection transistor configuring the detection switch 46 becomes smaller than the printing transistor in size (refer to FIG. 11B). Specifically, a size of the detection transistor is 1/10 of a size of the printing transistor in the embodiment. This is because there is no problem with an increase of resistance due to a small amount of current flowing into the residual vibration detection unit 60, and it is advantageous for a reduction in a layout area to be configured from a small-sized transistor. However, since a size of the detection switch 46 is small, it is concerned that the detection transistor configuring the detection switch 46 is destructed when applying static electricity.

Figure 15:
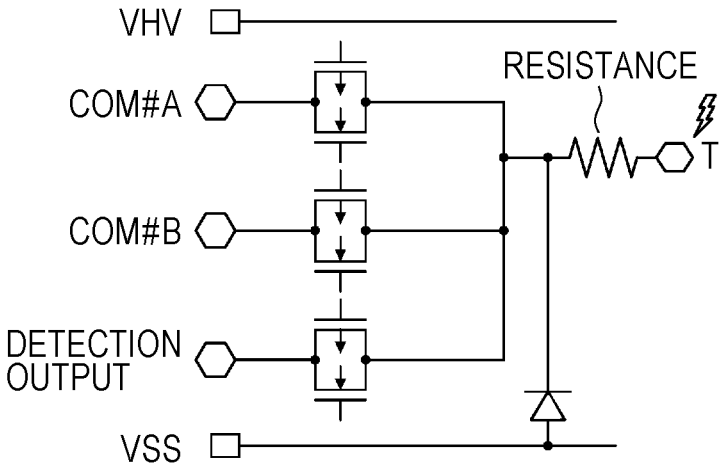
FIG. 15 is a layout diagram of a reference example.

In order to suppress a destruction of the detection switch 46, as shown in a reference example of FIG. 15, it is considered to alleviate an impact of static electricity by disposing a resistor in series with respect to the output terminal T, and limiting a current applied to the detection transistor of the detection switch 46. However, when the resistor is disposed as shown in FIG. 15, the resistor is disposed between the printing switches 46A and 46B and the output terminal T. Therefore, when driving the piezo element 47 by outputting the drive signal COM from the output terminal T through the printing switches 46A and 46B, a printing speed of time-taking in a charge or a discharge of the piezo element 47 is lowered and the heating problem also occurs. That is, when the resistor is disposed as shown in FIG. 15, an effect of a low resistance obtained by increasing a size of the printing transistor of the printing switches 46A and 46B is reduced. For this reason, a serial arrangement of the resistor as shown in FIG. 15 is avoided.

In the embodiment, as shown in FIG. 11B, a printing transistor is disposed between the detection transistor and the output terminal T. In other words, the detection transistor is spaced further away from the output terminal T than the printing transistor and is disposed at a rear side (an input side of the head controller HC). For example, the P-type printing transistor is disposed between the P-type detection transistor and the output terminal T in the P-type transistor area (the P-type detection transistor is disposed to be spaced further away from the output terminal T than the P-type printing transistor). Furthermore, the N-type printing transistor is disposed between the N-type detection transistor and the output terminal T in the N-type transistor area (the N-type detection transistor is disposed to be spaced further away from the output terminal T than the N-type printing transistor). That is, in the embodiment, as shown in FIG. 11B, a distance between the detection transistor and the output terminal T is greater than a distance between the printing transistor and the output terminal T.

Accordingly, since the printing transistor is disposed to be close to the output terminal T, the printing transistor with a large size can alleviate a current to the detection transistor in response to a load due to a static electricity, thereby suppressing a destruction of the detection transistor with a small size. That is, according to the embodiment, it is possible to ensure resistance to a static electricity applied to the detection transistor without disposing a resistor as shown in FIG. 15 between the printing switches 46A and 46B and the output terminal T.

In addition, the detection transistor and the printing transistor have a comparable width (dimension in an alignment direction of the output terminals of FIG. 11B). The width is narrower than 30 μm when an alignment section of the output terminals T is, for example, 30 μm. Accordingly, it is possible to dispose the printing transistor and the detection transistor as shown in FIG. 11B to be aligned in an elongated area (hereinafter, switching transistor area) in a direction intersecting with the alignment direction (corresponding to a predetermined direction) of the output terminals T. Thus, it is possible to lay out the printing transistor and the detection transistor with respect to each of the output terminals T aligned at narrow sections.

In addition, when the detection transistor and the printing transistor have a comparable width (dimension in an alignment direction of the output terminals of FIG. 11B), a size of a transistor is determined by a length (a dimension in a direction intersecting with the alignment direction of the output terminals in FIG. 11B) of a transistor. Since the printing transistor is larger than the detection transistor in size in the embodiment, a length (dimension in a direction intersecting with an alignment direction of the output terminals in FIG. 11B) of the printing transistor is longer than a length of the detection transistor. As a result, in this embodiment, since the printing transistor with a long dimension is disposed between the detection transistor and the output terminal T, it is possible to increase a distance between the detection transistor and the output terminal T, which is advantageous for a layout.

In addition, a P-type transistor of each of the printing transistor and the detection transistor is formed in a common N-well, and an N-type transistor of each of the printing transistor and the detection transistor is formed in a common P-well in the embodiment. Accordingly, it is possible to more efficiently lay out the printing transistor and the detection transistor, and to achieve a reduction in area.

Improved Example of First Embodiment

Figure 12:
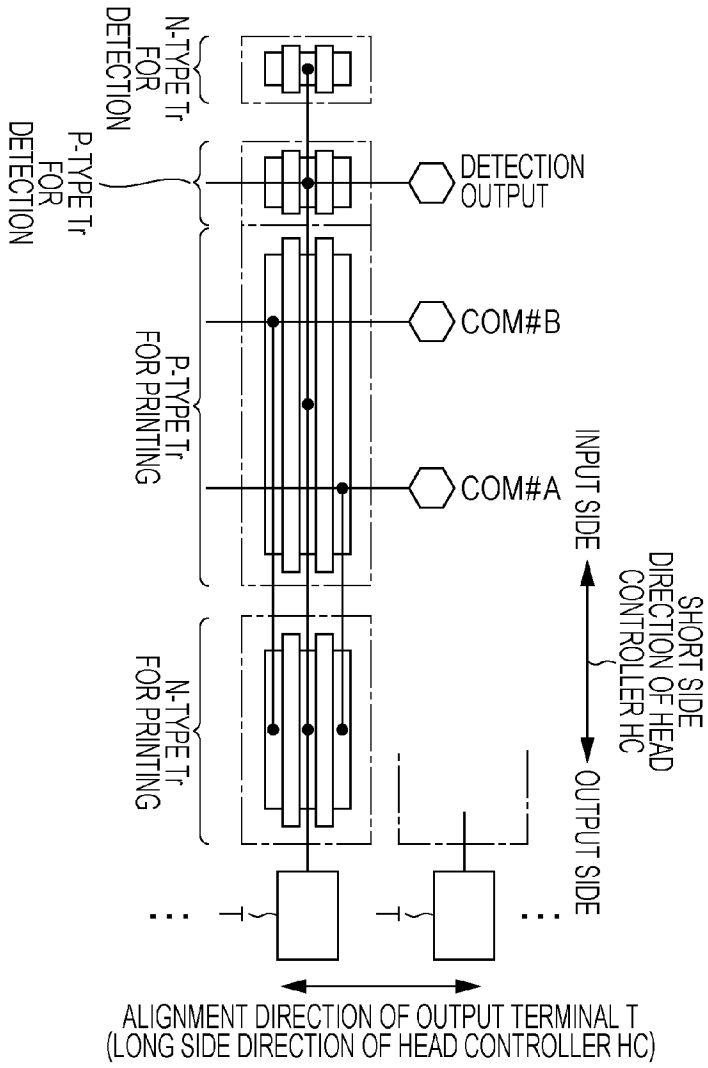
FIG. 12 is a layout diagram of an improved example of the first embodiment.

FIG. 12 is a layout diagram of an improved example of the first embodiment.

In an improved example, both the P-type printing transistor and the N-type printing transistor are disposed between the P-type detection transistor and the N-type detection transistor and the output terminal T. In other words, the P-type detection transistor and the N-type detection transistor are spaced further away from the output terminal T than either of the P-type printing transistor and the N-type printing transistor and are disposed at a rear side (an input side of the head controller HC). Specifically, the N-type printing transistor, the P-type printing transistor, the P-type detection transistor, and the N-type detection transistor are disposed in order from a side of the output terminal T. In an improved example, the N-type detection transistor is disposed to be spaced further away from the output terminal T than in a layout of the first embodiment (FIG. 11B). Accordingly, it is possible to ensure more resistance to the static electricity applied to the detection transistor than in a layout of FIG. 11B.

In the improved example shown in FIG. 12, the P-type detection transistor is disposed further on the printing transistor side than the N-type detection transistor. This is because it is possible to form an N-well continuously with the N-well of the P-type printing transistor. Accordingly, it is possible to achieve a reduction in layout area.

In addition, in a case of FIG. 11B described above, since the N-type detection transistor is disposed between the N-type printing transistor and the P-type printing transistor, it is necessary to connect a wiring of the N-type printing transistor and a wiring of the P-type printing transistor so as to avoid the N-type detection transistor. Therefore, connected wirings of the N-type printing transistor and the P-type printing transistor become thin and resistance increases.

In contrast, in the improved example shown in FIG. 12, the detection transistor is not disposed between the N-type printing transistor and the P-type printing transistor. Therefore, the connected wirings of the N-type printing transistor and the P-type printing transistor do not need to be narrowed.

Second Embodiment

Figure 13A:
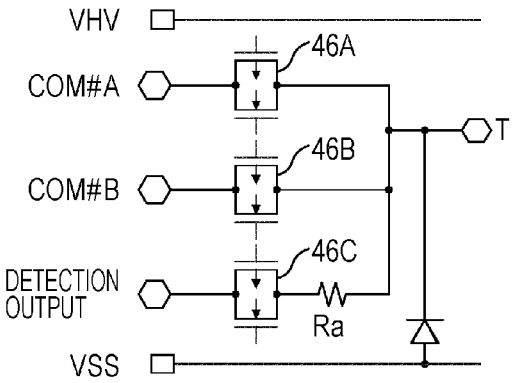
FIG. 13A is a circuit diagram of the periphery of an output terminal of a second embodiment.
Figure 13B:
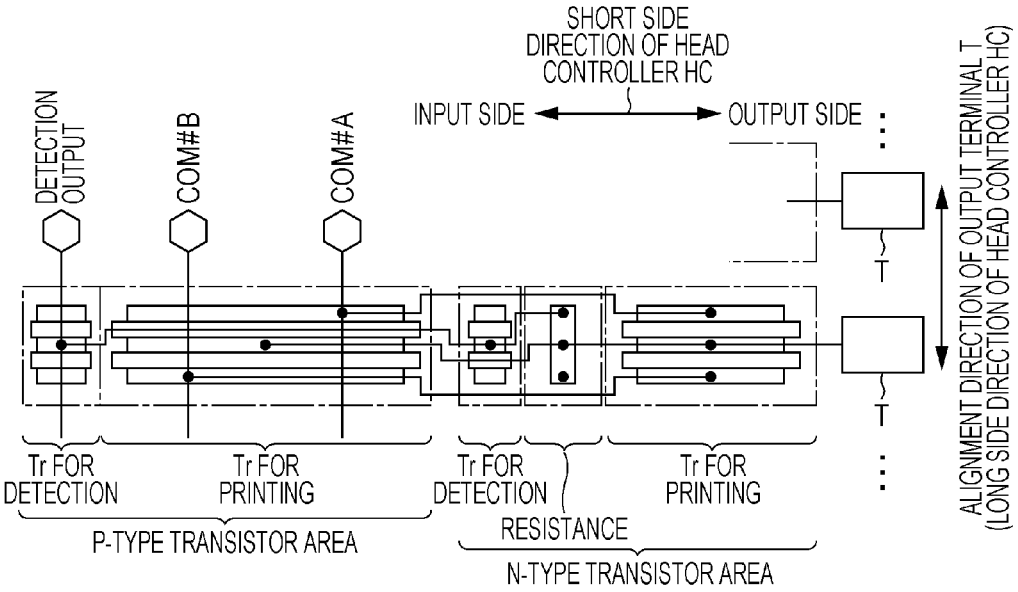
FIG. 13B is a layout diagram of the periphery of the output terminal of the second embodiment.

FIG. 13A is a circuit diagram of the periphery of the output terminal T of a second embodiment, and FIG. 13B is a layout diagram of the periphery of the output terminal T of the second embodiment.

In the second embodiment, a resistor Ra is added to a circuit configuration of the first embodiment.

Specifically, the detection switch 46C and the resistor Ra are disposed in series. Then, the detection switch 46C and the resistor Ra, which are disposed in series, and the printing switches 46A and 46B are disposed in parallel with respect to the output terminal T.

According to the second embodiment, since the resistor Ra is disposed between the detection switch 46C and the output terminal T, and the resistor Ra restricts a current to the detection switch 46C in an application of a static electricity, it is possible to protect (current limit) the detection switch with respect to the static electricity from the output terminal T. Since a current flowing to the residual vibration detection unit 60 is small, a resistor is allowed to be disposed. In addition, since the resistor Ra is not disposed between the printing switches 46A and 46B and the output terminal T, a problem of taking time in charging or discharging of the piezo element 47 and a heating problem do not occur due to the resistance Ra.

Improved Example of Second Embodiment

Figure 14:
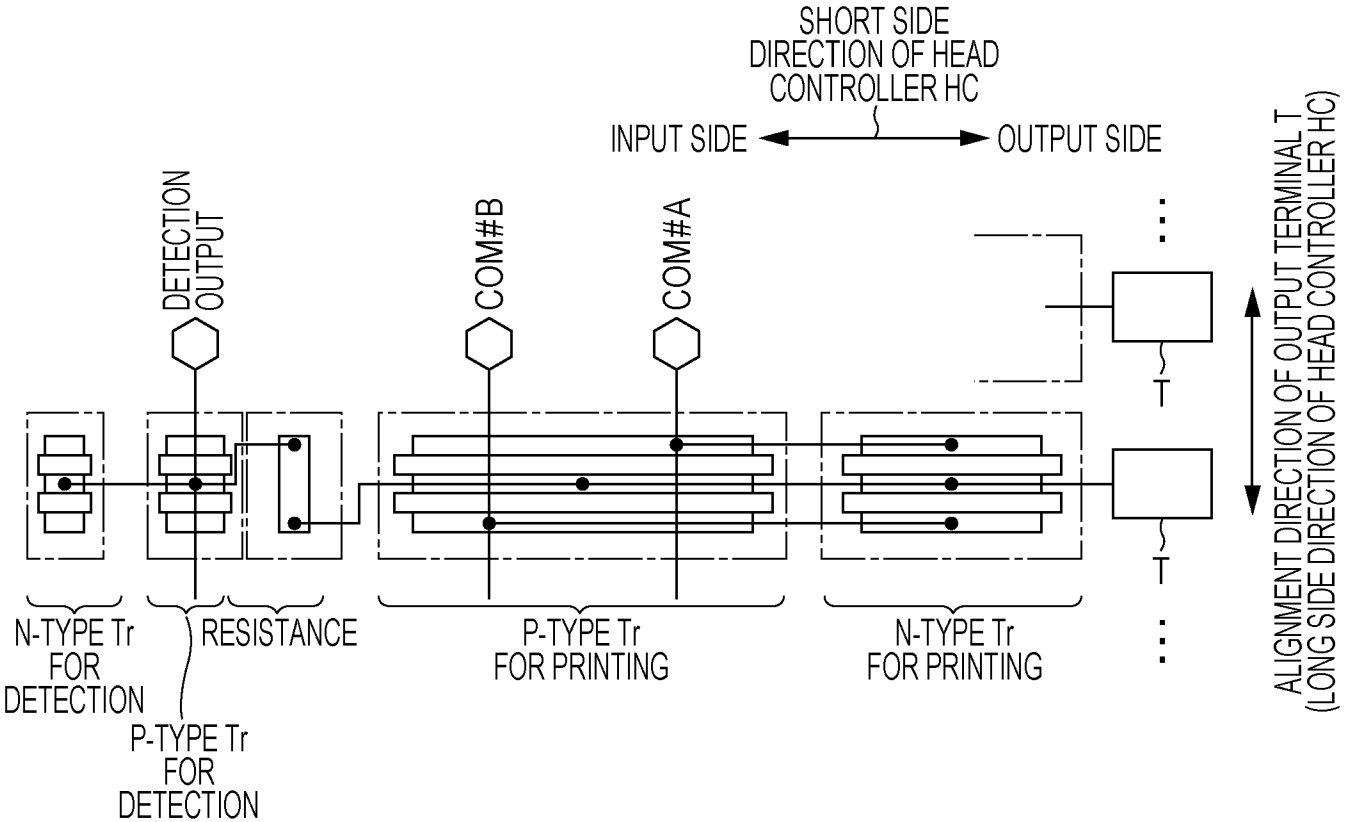
FIG. 14 is a layout diagram of an improved example of the second embodiment.

FIG. 14 is a layout diagram of an improved example of the second embodiment.

In an improved example of the second embodiment, in the same manner as that of the improved example of the first embodiment, both a P-type printing transistor and an N-type printing transistor are disposed between a P-type detection transistor and an N-type detection transistor and the output terminal T. In other words, the P-type detection transistor and the N-type detection transistor are spaced further away from the output terminal T than either one of the P-type printing transistor and the N-type printing transistor and are disposed at the rear side (the input side of the head controller HC). Specifically, the N-type printing transistor, the P-type printing transistor, a resistor, the P-type detection transistor, and the N-type detection transistor are disposed in order from a side of the output terminal T. In an improved example, the N-type detection transistor is disposed to be spaced further away from the output terminal T than in a layout of the second embodiment (FIG. 13B). Accordingly, it is possible to ensure more resistance to the static electricity applied to the detection transistor than in a layout of FIG. 11B.

In addition, in FIG. 13 described above, since the N-type detection transistor and the resistor are disposed between the N-type printing transistor and the P-type printing transistor, it is necessary to connect a wiring of the N-type printing transistor and a wiring of the P-type printing transistor so as to avoid the N-type detection transistor and the resistor. Therefore, the connected wirings of the N-type printing transistor and the P-type printing transistor become thin and resistance increases.

In contrast, in the improved example shown in FIG. 14, the detection transistor or the resistor is not disposed between the N-type printing transistor and the P-type printing transistor. Therefore, the connected wirings of the N-type printing transistor and the P-type printing transistor are not needed to be narrowed.

Furthermore, according to an improved example of the second embodiment, a resistor is disposed between the detection transistor and the printing transistor. Accordingly, according to the improved example of the second embodiment, the detection transistor can be disposed to be spaced further away from the output terminal T than in the improved example (refer to FIG. 12) of the first embodiment.

Other Embodiments

The above embodiments are intended to facilitate an understanding of the present invention, but are not intended to limit the invention for an interpretation. The invention may be modified or improved without departing from a spirit thereof, and equivalents thereof are, of course, included in the invention.

Printer 1

In the embodiment described above, a liquid discharge apparatus is a serial type printer in which the head 41 moves. However, the liquid discharge apparatus may be a line type printer with a fixed head. In addition, the liquid discharge apparatus is not limited to a printer which discharges an ink. For example, the liquid discharge apparatus may be a processing device which discharges a processing fluid from a nozzle.

Piezo Element 47

In the embodiment described above, the piezo element 47 is used as a drive element which discharges an ink from a nozzle. However, the drive element which discharges an ink from a nozzle is not limited to the piezo element 47, but may be another piezo element.

Drive Signal COM

In the embodiment described above, two types of drive signals (the first drive signal COM#A and the second drive signal COM#B) are applied to the piezo element 47 using two printing switches (46A and 46B); however, the drive signals are not limited thereto. The drive signal COM may be one. In this case, the printing switch may be one. Residual vibration detection unit 60

A configuration of the residual vibration detection unit 60 is not limited to the above description, but may be a detection circuit of another configuration. For example, the second high pass filter 62 may be configured from the high pass filter 62B only. In this case, an amplification of a single input is used for the differential amplifier 64.

In addition, for example, the low pass filter 65 may not be used.

What is claimed is:

1. A semiconductor device which is provided to correspond to each of a plurality of nozzles discharging a liquid and controls a plurality of drive elements causing a liquid to be discharged from each nozzle with an application of a drive signal, the semiconductor device comprising:

a detection circuit which detects a residual vibration signal of the drive element;

an output terminal which is provided to correspond to each of the plurality of drive elements;

a discharge transistor which is provided to correspond to each of the plurality of drive elements and controls an application of the drive signal to the drive element through the output terminal; and a detection transistor which is provided to correspond to each of the plurality of drive elements and controls an application of the residual vibration signal to the detection circuit through the output terminal, wherein the detection transistor is smaller than the discharge transistor in size, and the discharge transistor is disposed between the detection transistor and the output terminal.

2. The semiconductor device according to claim 1, wherein the plurality of output terminals are disposed in a predetermined direction, the discharge transistor and the detection transistor corresponding to the output terminal are disposed to be aligned in a direction intersecting with the predetermined direction, and a length of the discharge transistor in the direction intersecting with the predetermined direction is longer than a length of the detection transistor.

3. The semiconductor device according to claim 1, wherein the discharge transistor and the detection transistor are configured as a transfer gate with an N-type transistor and a P-type transistor, respectively, and the N-type transistors, the P-type transistors, or both the N-type transistors and the P-type transistors of the discharge transistor and the detection transistor are formed in a common well.

4. The semiconductor device according to claim 1, wherein the discharge transistor and the detection transistor are configured as a transfer gate with the N-type transistor and the P-type transistor, respectively, and both the N-type transistor and the P-type transistor which configure the discharge transistor are disposed between the N-type transistor and the P-type transistor which configure the detection transistor and the output terminal.

5. The semiconductor device according to claim 1, wherein a resistor is provided between the detection transistor and the output terminal corresponding to the detection transistor.

6. A liquid discharge head which causes a liquid to be discharged from each nozzle by applying a drive signal to a plurality of drive elements provided to correspond to each of a plurality of nozzles discharging a liquid, the liquid discharge head comprising:

a semiconductor device which includes a detection circuit that detects a residual vibration signal of the drive element, an output terminal that is provided to correspond to each of the plurality of drive elements, a discharge transistor that is provided to correspond to each of the plurality of drive elements and controls an application of the drive signal to the drive element through the output terminal, and a detection transistor that is provided to correspond to each of the plurality of drive elements and controls an application of the residual vibration signal to the detection circuit through the output terminal, and which controls the plurality of drive elements performing a liquid discharge operation in each nozzle, wherein the detection transistor is smaller than the discharge transistor in size, and the discharge transistor is disposed between the detection transistor and the output terminal.

7. A liquid discharge apparatus which causes a liquid to be discharged from each nozzle by applying a drive signal to a plurality of drive elements provided to correspond to each of a plurality of nozzles discharging a liquid, the liquid discharge apparatus comprising:

a semiconductor device which includes a detection circuit which detects a residual vibration signal of the drive element, an output terminal which is provided to correspond to each of the plurality of drive elements, a discharge transistor which is provided to correspond to each of the plurality of drive elements and controls an application of the drive signal to the drive element through the output terminal, and a detection transistor which is provided to correspond to each of the plurality of drive elements and controls an application of the residual vibration signal to the detection circuit through the output terminal, and which controls the plurality of drive elements performing the liquid discharge operation in each nozzle, wherein the detection transistor is smaller than the discharge transistor in size, and the discharge transistor is disposed between the detection transistor and the output terminal.

* * * * *